US006747255B2

(12) United States Patent
Lee et al.

(10) Patent No.: US 6,747,255 B2
(45) Date of Patent: Jun. 8, 2004

(54) MICROWAVE OVEN WITH INCREASED USABLE SPACE

(75) Inventors: Se-hun Lee, Suwon (KR); Sang-jin Jung, Suwon (KR)

(73) Assignee: Samsung Electronics Co., Ltd., Suwon (KR)

( * ) Notice: Subject to any disclaimer, the term of this patent is extended or adjusted under 35 U.S.C. 154(b) by 41 days.

(21) Appl. No.: 10/102,008

(22) Filed: Mar. 21, 2002

(65) Prior Publication Data

US 2003/0178420 A1 Sep. 25, 2003

(51) Int. Cl.[7] ..... H05B 6/78

(52) U.S. Cl. ..... 219/754; 219/756; 219/762; 126/338

(58) Field of Search ..... 219/754, 762, 219/763, 388, 389, 392; 126/338, 339, 340; 99/443 R

(56) References Cited

U.S. PATENT DOCUMENTS 3,440,385 A * 4/1969 Smith ..... 219/754
4,107,502 A * 8/1978 Tanaka et al. ..... 219/754
5,097,106 A * 3/1992 Arai et al. ..... 219/754
5,674,421 A * 10/1997 Beaver, II et al. ..... 219/385
6,252,214 B1 * 6/2001 Han et al. ..... 219/754
2003/0089708 A1 * 5/2003 Hudson et al. ..... 219/754

FOREIGN PATENT DOCUMENTS

KR 2001-077299 * 8/2001

* cited by examiner

*Primary Examiner*—Philip H. Leung
(74) *Attorney, Agent, or Firm*—Staas & Halsey LLP

(57) ABSTRACT

Disclosed is a microwave oven comprising a main casing, a cavity casing combined to the main casing so as to form a cooking compartment and having opposite side walls and a bottom plate, and a tray rotatably seated on the bottom plate of the cavity casing, the bottom plate of the cavity casing comprising a tray seating part for seating the tray on the center thereof; and an elevated part protruded upwardly around the tray seating part. With this configuration, the present invention provides a microwave oven which can increase the amount of food accommodated therein.

7 Claims, 5 Drawing Sheets

MICROWAVE OVEN WITH INCREASED USABLE SPACE

BACKGROUND OF THE INVENTION

1. Field of the Invention

The present invention relates in general to a microwave oven, and more particularly, to a microwave oven improved in a structure of a cavity casing forming a cooking compartment.

2. Description of the Related Art

FIG. 4 is an exploded perspective view of a conventional microwave oven, and FIG. 5 is a sectional view of FIG. 4, taken along line V—V, for illustrating the state that a cavity casing is combined to a main casing. As shown therein, a conventional microwave oven 101 comprises a main casing 110 formed with a cooking compartment 121 and a component compartment 122, a cavity casing 120 provided inside the main casing 110, an outer casing 105 having an inverted "U" shape and covering the main casing 110 and the cavity casing 120, and a door 107 provided in the front of the main casing 110 and opening/closing an opening 118 of the cooking compartment 121.

The main casing 110 is comprised of a lower plate 111, a front plate 113 standing on the front of the lower plate 111 and provided with the opening 118 having an approximately rectangular shape, a rear plate 115 standing on the rear of the lower plate 111. Inside the main casing 110 is provided the cavity casing 120 forming the cooking compartment 121.

The cavity casing 120 is of an approximately rectangular box shape opened forward and backward, and edges thereof are each provided with flanges 123*a* and 123*b* which are bent outwardly. Further, on a bottom of the cooking compartment 121, i.e., on the bottom plate 125 of the cavity casing 120 is provided a tray seating part 131 having a circular shape and recessed downwardly. On the tray seating part 131 is seated a rotatable tray 141 for putting food thereon, and under the center of the tray seating part 131 is provided a driving motor 143 for rotating the rotatable tray 141.

The cavity casing 120 is coupled to the main casing 110 by projection welding in the state that the front flange 123*a* thereof is in contact with the edge of the opening 118 provided on the front plate 113 of the main casing 110 and the rear flange 123*b* thereof is in contact with the rear plate 115 of the main casing 110, respectively.

Herein, the projection welding is a kind of a resistance welding. According to the projection welding, a projection part is interposed between two metal workpieces at predetermined intervals, and high electric current is applied to the projection part. Then, heat generated due to resistance of the projection part melts the projection part, so that the melted projection part joins two metal workpices together.

However, according to the conventional microwave oven 101, in order to perform the projection welding for coupling the cavity casing 120 to the front plate 113 and the rear plate 115 of the main casing 110, there is in need of a sufficient space for inserting a welding electrode 150 between the front plate 113 or the rear plate 115 of the main casing 110 and the tray seating part 131 of the cavity casing 120, so that the diameter of the tray seating part 131 should be small in comparison with the width of the cooking compartment 121.

Moreover, according as the diameter of the tray seating part 131 is relatively small, the diameter of the rotatable tray 141 seated on the tray seating part 131 should get small, so that the amount of food accommodated in the microwave oven is also small.

SUMMARY OF THE INVENTION

Accordingly, the present invention has been made keeping in mind the above-described shortcomings and user's need, and an object of the present invention is to provide a microwave oven in which a tray seating part and a rotatable tray are enlarged, securing a sufficient space needed for performing welding work.

This and other objects of the present invention may be accomplished by the provision of a microwave oven comprising a main casing, a cavity casing combined to the main casing so as to form a cooking compartment and having opposite side walls and a bottom plate, and a tray rotatably seated on the bottom plate of the cavity casing, the bottom plate of the cavity casing comprising a tray seating part for seating the tray on the center thereof; and an elevated part protruded upwardly around the tray seating part.

Preferably, between the elevated part and the tray seating part is provided an inclined part.

Preferably, between the elevated part and the each side wall of the cavity casing is provided a recess part.

Preferably, the elevated part forms a pair, being oppositely provided around the tray seating part, and having open parts forward and backward.

BRIEF DESCRIPTION OF THE DRAWINGS

The present invention will be better understood and its various objects and advantages will be more fully appreciated from the following description taken in conjunction with the accompanying drawings, in which.

DETAILED DESCRIPTION OF THE PREFERRED EMBODIMENT

The present invention will be described in more detail with reference to the accompanying drawings.

Figure 1:
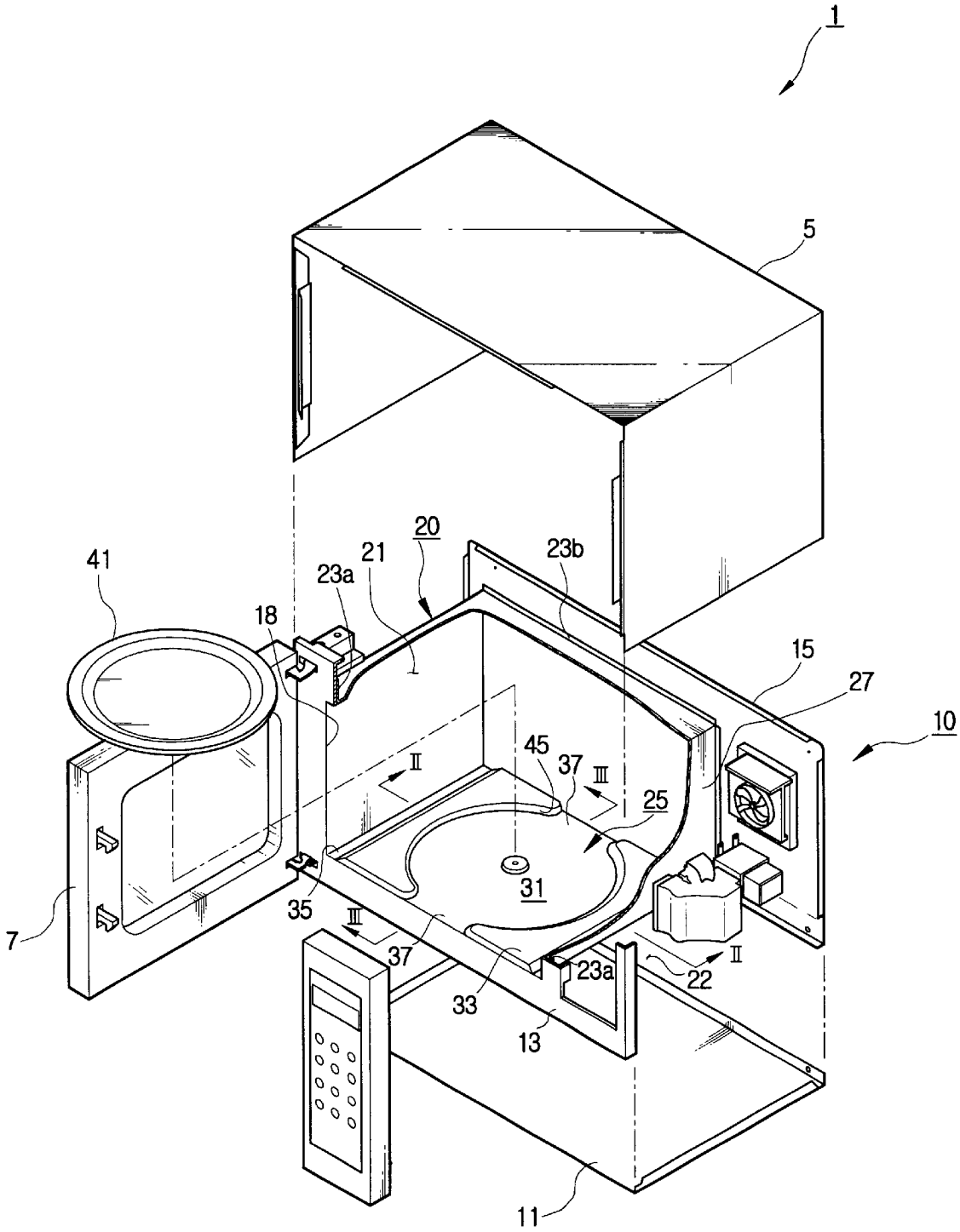
FIG. 1 is an exploded perspective view of a microwave oven according to the present invention.
Figure 2:
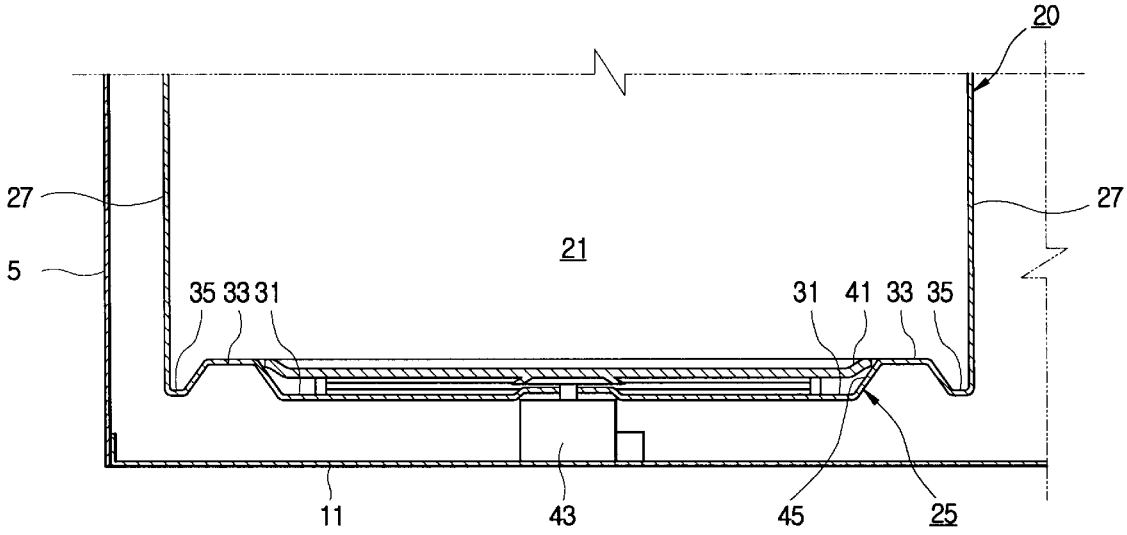
FIG. 2 is a sectional view of FIG. 1, taken along line II—II.
Figure 3:
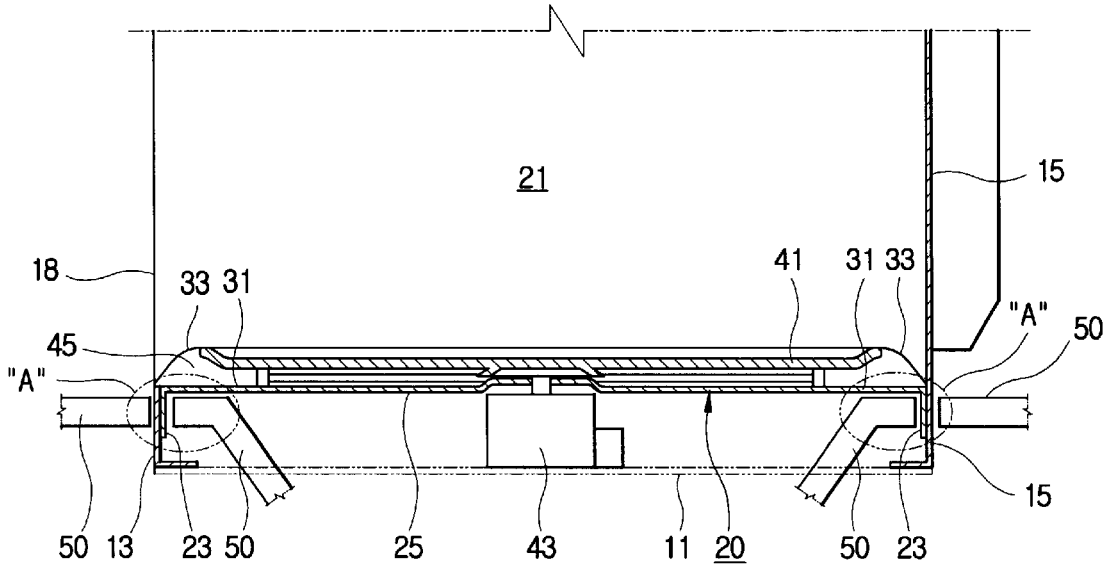
FIG. 3 is a sectional view of FIG. 1, taken along line III—III, for illustrating the state that a cavity casing is combined to a main casing.
Figure 4:
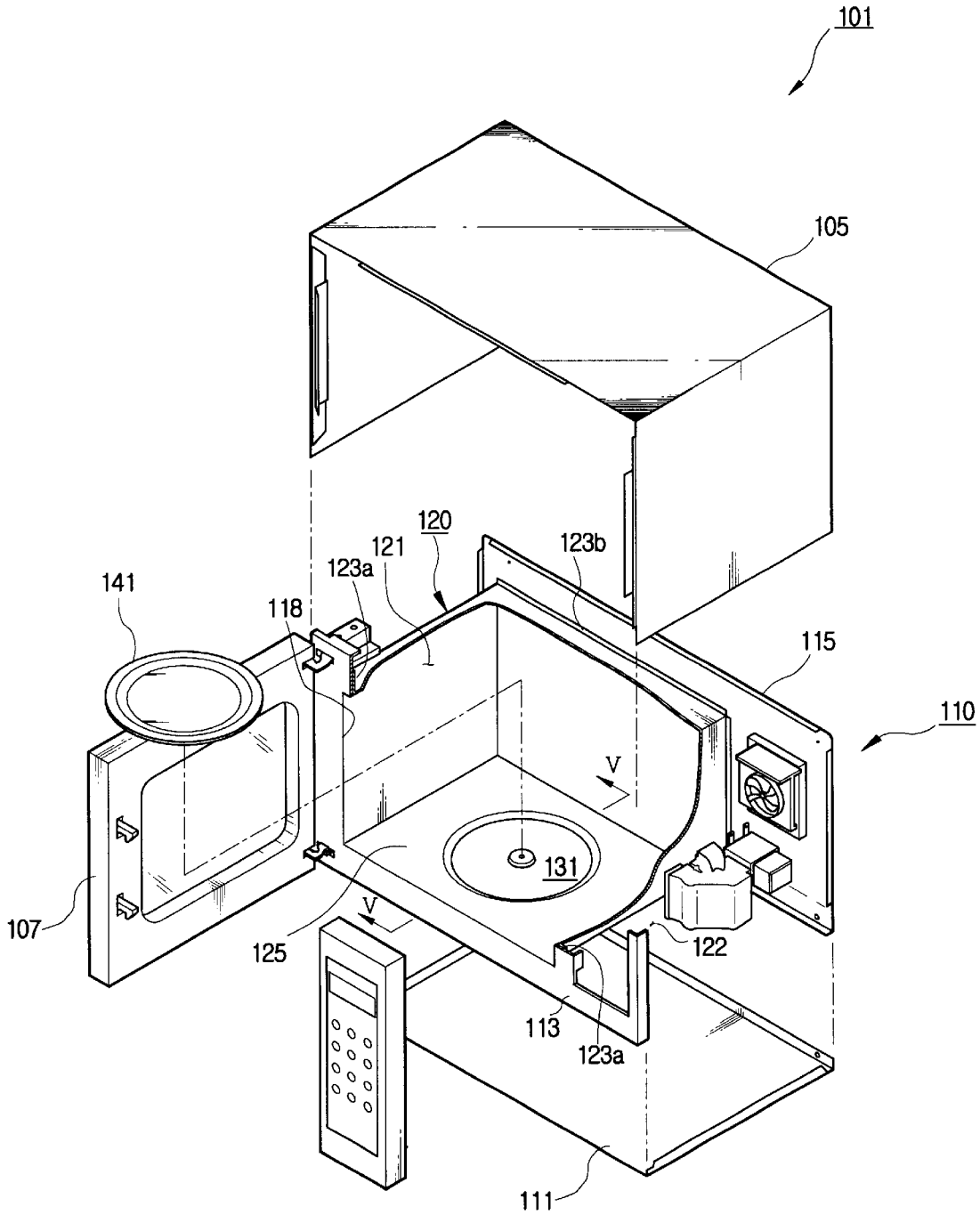
FIG. 4 (PRIOR ART)
FIG. 4 is an exploded perspective view of a conventional microwave oven.
Figure 5:
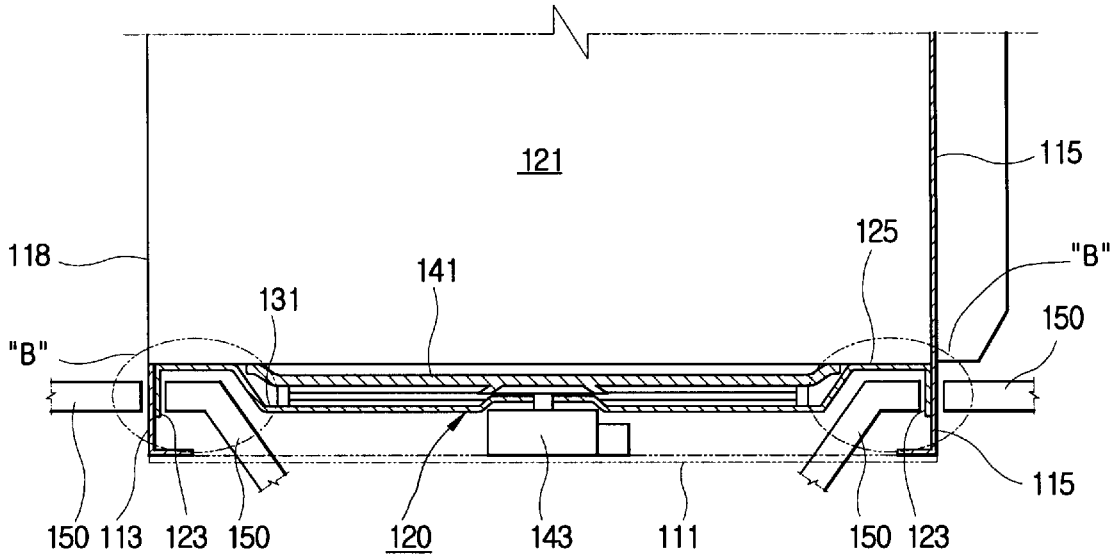
FIG. 5 (PRIOR ART)
FIG. 5 is a sectional view of FIG. 4, taken along line V—V, for illustrating the state that a cavity casing is combined to a main casing.

FIG. 1 is an exploded perspective view of a microwave oven according to the present invention, FIG. 2 is a sectional view of FIG. 1, taken along line II—II, and FIG. 3 is a sectional view of FIG. 1, taken along line III—III, for illustrating the state that a cavity casing is combined to a main casing. As shown therein, a microwave oven 1 according to the present invention comprises a main casing 10 formed with a cooking compartment 21 and a component compartment 22, a cavity casing 20 provided inside the main casing 10, an outer casing 105 having an inverted "U" shape and covering the main casing 10 and the cavity casing 20, and a door 7 provided in the front of the main casing 10 and opening/closing an opening 18 of the cooking compartment 21.

The main casing 10 is comprised of a lower plate 11, a front plate 13 standing on the front of the lower plate 11 and provided with the opening 18 having an approximately rectangular shape, a rear plate 15 standing on the rear of the lower plate 11. Inside the main casing 10 is provided the cavity casing 20 forming the cooking compartment 21.

The cavity casing 20 forming the cooking compartment 21 is of an approximately rectangular box shape opened forward and backward, and edges thereof are each provided with flanges 23*a* and 23*b* which are bent outwardly. The cavity casing 20 is, as shown in FIG. 3, coupled to the main casing 10 by projection welding in the state that the front flange 23*a* thereof is in contact with the edge of the opening 18 provided on the front plate 13 of the main casing 10 and the rear flange 23*b* thereof is in contact with the rear plate 15 of the main casing 10, respectively.

Further, on the bottom of the cooking compartment 21, i.e., on a bottom plate 25 of the cavity casing 20 are provided a tray seating part 31 seating a rotatable tray 41 (to be described later) thereon, a pair of elevated parts 33 oppositely provided around the tray seating part 31, and a pair of recess parts 35 each recessed downward from the elevated parts 33 and connected to the side walls 27 of the cavity casing 20.

The elevated parts 33 may be molded so as to be protruded upwardly. The elevated parts 33 each have an inclined part 45 concavely curved toward the center of the bottom plate 25. Between the opposite inclined parts 45 are provided open parts 37 opening toward and backward, so that the tray seating part 31 may have at least the same diameter as the width between the front and the rear of the bottom plate 25. Further, the recess part 35 is preferably level with the tray seating part 31. That is, the tray seating part 31 and the recess part 35 are created by protruding upwardly the elevated part 33 from the bottom plate 25 of the cavity casing 20. Therefore, while the flanges 23*a* and 23*b* each bent from the front and the rear of the bottom plate 25 of the cavity casing 20 are welded to the front plate 13 and the rear plate 15 of the main casing 10, respectively, a welding electrode 50 for the projection welding can be easily accommodated under the bottom plate 25 without interference, as shown in "A" of FIG. 3.

On the tray seating part 31 provided between the elevated parts 33 is seated the rotatable tray 41 for putting food thereon, and under the center of the tray seating part 31 is provided a driving motor 43 for rotating the rotatble tray 41. Herein, the diameter of the rotatable tray 41 becomes relatively large in correspondence with the diameter of the tray seating part 31.

Thus, a tray seating part for seating a rotatable tray thereon is formed by protruding upwardly a pair of elevated parts from a bottom plate of a cavity casing without recessing downwardly the bottom plate of the cavity casing, so that the tray seating part and the rotatable tray can be relatively enlarged, securing a sufficient space accommodating a welding electrode needed for welding the cavity casing to a main casing, thereby increasing the amount of food accommodated in the microwave oven.

As described above, the present invention provides a microwave oven in which a tray seating part and a rotatable tray are enlarged, securing a sufficient space needed for performing welding work.

Although the preferred embodiments of the present invention have been disclosed for illustrative purpose, those skilled in the art will appreciate that various modifications, additions and substitutions are possible, without departing from the scope and spirit of the invention as disclosed in the accompanying claims.

What is claimed is:

1. A microwave oven comprising a main casing, a cavity casing combined to the main casing so as to form a cooking compartment and having opposite side walls and a bottom plate, and a tray rotatably seated on the bottom plate of the cavity casing, the bottom plate of the cavity casing comprising:

a tray seating part for seating the tray on the center thereof; and an elevated part protruded upwardly around the tray seating part, wherein between the elevated part and the each side wall of the cavity casing is provided a recess part.

2. The microwave oven according to claim 1, wherein between the elevated part and the tray seating part is provided an inclined part.

3. The microwave oven according to claim 2, wherein the elevated part forms a pair, being oppositely provided around the tray seating part, and laying open parts each facing the tray seating part to accommodate rotation of the tray.

4. The microwave oven according to claim 1, wherein the elevated part forms a pair, being oppositely provided around the tray seating part, and having open parts each facing the tray seating part to accommodate rotation of the tray.

5. A microwave oven having a main casing, a cavity casing combined with the main casing to form a cooking compartment with opposite side walls and a bottom plate, and a tray rotatably seated on the bottom plate of the cavity casing, the bottom plate of the cavity casing comprising:

a tray seating part seating the tray on a center thereof; and a pair of elevated portions positioned near the side walls to provide a recessed area between the side walls and the elevated portions,forming a central open area shaped to accommodate rotation of the tray.

6. The microwave oven of claim 5, further comprising an inclined part between the elevated part and the tray seating part.

7. The microwave oven of claim 5, wherein the pair of elevated portions form a central open area shaped to accommodate rotation of the tray.

* * * * *

UNITED STATES PATENT AND TRADEMARK OFFICE

CERTIFICATE OF CORRECTION

PATENT NO. : 6,747,255 B2
DATED : June 8, 2004
INVENTOR(S) : Se-hun Lee et al.

It is certified that error appears in the above-identified patent and that said Letters Patent is hereby corrected as shown below:

Column 4,
Line 32, change “laying” to -- having --.

Signed and Sealed this

Nineteenth Day of October,2004

JON W. DUDAS
*Director of the United States Patent and Trademark Office*